US005920937A

United States Patent [19]

Tracy

[11] Patent Number: 5,920,937

[45] Date of Patent: Jul. 13, 1999

[54] COVERING APPARATUS FOR CONCRETE BRIDGE BEAMS AND PILLARS

[76] Inventor: James G. Tracy, 101 Knollwood Rd., Fayetteville, N.Y. 13066

[21] Appl. No.: 08/890,837

[22] Filed: Jul. 10, 1997

[51] Int. Cl.[6] ..... E01D 19/10

[52] U.S. Cl. ..... 14/74.5; 14/75

[58] Field of Search ..... 14/74, 74.5, 76.5, 14/78; 404/2; 52/58, 62, 302.6, 407.3

[56] References Cited

U.S. PATENT DOCUMENTS

| | | | |
|---|---|---|---|
| 3,416,270 | 12/1968 | McHugh | 52/58 |
| 3,461,625 | 8/1969 | Sandow | 52/58 |
| 4,848,049 | 7/1989 | Hanson | 52/58 |
| 4,970,837 | 11/1990 | Fogelstrom | 52/58 |
| 5,400,454 | 3/1995 | Cunningham | 14/75 |
| 5,655,243 | 8/1997 | Kim | 14/74.5 |

*Primary Examiner*—Thomas B. Will
*Assistant Examiner*—Raymond Addie
*Attorney, Agent, or Firm*—George R. McGuire

[57] ABSTRACT

A system for covering and protecting the supporting structure of a bridge. The system is generally comprised of first plates positioned in covering relation over the top surface of the support pillars and second plates positioned in covering relation over the spans of beam which interconnect the pillars. The cover plates overhang the pillars and beam spans and include flashings and gutters appropriately positioned in order to channel and direct water away from the bridge support structure. In bridge constructions which utilize two I-beams extending in spaced, parallel relation to one another, a third plate is securely attached to, and positioned in between the two I-beams, and includes a gutter which carries water away from the bridge support structure.

15 Claims, 5 Drawing Sheets

COVERING APPARATUS FOR CONCRETE BRIDGE BEAMS AND PILLARS

BACKGROUND OF THE INVENTION

The present invention generally relates to apparatus for diminishing and/or preventing erosion to concrete and metal bridge support structures, and more particularly to plates positioned in covering relation to bridge beams and pillars in order to prevent water, salt, the freeze/thaw cycle, dissolution by acid rain/snow and other eroding elements from infiltrating and degrading the concrete and metal structures.

Bridges regularly undergo maintenance and reconstruction to ensure that they are safe for travel. Primarily what needs to be maintained are the columns and beams which support the bridge's road surface. A combination of heat, cold, rain, snow, acid rain and ice, in addition to the presence of salt cause the concrete and metal structural supports to naturally rust and/or degrade.

In order to minimize the damage to bridges caused by these naturally occurring elements, several pieces of apparatus to be added to a bridge's construction have been proffered. Most of the proposed apparatus is embodied in the form of a covering to be placed over the various bridge members that need protection from the elements. Examples of such bridge covering apparatus can be readily seen in U.S. Pat. Nos. 1,098,243 to Freeny; 319,798 to Dennis; 173,361 to Spaulding; 132,972 to Mills and Smith; and 54,004 to Monroe. Those apparatus and the others in this field of invention were generally and necessarily conforming to the bridge structures of their day, which are, due to the prevalence of modern day automotive vehicles, among other things, somewhat different from the bridge structures of today.

Accordingly, it is a principal object of the present invention to provide an apparatus effective at diminishing the rate of degradation currently realized by bridge support structures.

It is a further object and advantage of the present invention to provide a system of bridge beam and pillar covers which are easily and inexpensively manufactured.

It is another object and advantage of the present invention to provide a system of bridge beam and pillar covers that may either be retrofit onto existing bridges or installed in a new bridge construction.

Other objects and advantages of the present invention will in part be obvious and in part appear hereinafter.

SUMMARY OF THE PRESENT INVENTION

In accordance with the foregoing objects and advantages, the present invention provides a system of bridge beam and pillar covers which will prevent rain, heat, snow, ice, acid rain and salt from directly contacting the bridge support structures. The system of covers consists in part of a plurality of essentially square plates having square holes formed concentrically therethrough, each of which is positioned in complete covering relation atop a respective bridge pillar with the plate's central opening permitting a conventional beam weld plate (positioned on each pillar) to protrude therethrough. An additional part of the cover plate system is a plurality of recti-linear plates, each one being positioned across a respective beam section spanning between consecutively spaced pillars. The combination of the square pillar plates and the recti-linear beam plates provides complete protection for the portions of the bridge support structure that realize the greatest weather damage.

The square pillar plates each overhang the pillars a predetermined amount and each is diagonally scored and bent downwardly along the score lines, thereby, in essence, breaking each plate up into four discrete sections. Due to the diagonal scoring, each section slopes downwardly away from the pillar's center. Along the plate's side edges which overhang the bridge's beam, the edges are turned upwardly to form a gutter, thereby preventing water from falling onto the beam (or the beam's cover plate). The plate's edges which overhang the ground are bent downwardly at an oblique angle to effectively form a flashing, thereby causing water to drip directly downwardly therefrom, as opposed to sticking to the plate's bottom surface and running to the pillar. The scoring of the plates provides additional stiffness, rigidity, and strength thereto.

The recti-linear beam plates each extend along the entire span between consecutively spaced pillars and overhang the beam by a predetermined amount, and each is scored and bent downwardly along its longitudinal axis, thereby causing water to run off the side of the plate to which it falls. Like the square, pillar plates, the edges of the recti-linear, beam plates which overhang the ground are bent downwardly at an oblique angle to act as a flashing and prevent water from creeping back to the beam. Similarly, the edges of the recti-linear, beam plates which abut the pillars are bent upwardly to gutter water way from the pillars.

As an additional feature of the present invention, for bridges having two support I-beams extending in parallel relation to one another and mounted to each pillar, a gutter may be positioned in between the two I-beams to channel any water that may fall between the I-beams. The gutter consists of an elongated V-shaped gutter having flanges extending outwardly from each of its two terminal ends. Each flange is welded to the upper upwardly facing surface of the I-beam's lower leg, thereby completely bridging the gap that would otherwise exist between the two I-beams. Use of the I-beam gutters on bridge constructions utilizing two I-beams per pillar, in combination with the square pillar plates and recti-linear beam plates, will provide complete cover to the upper portions of the pillars and beams.

DETAILED DESCRIPTION

Figure 1:
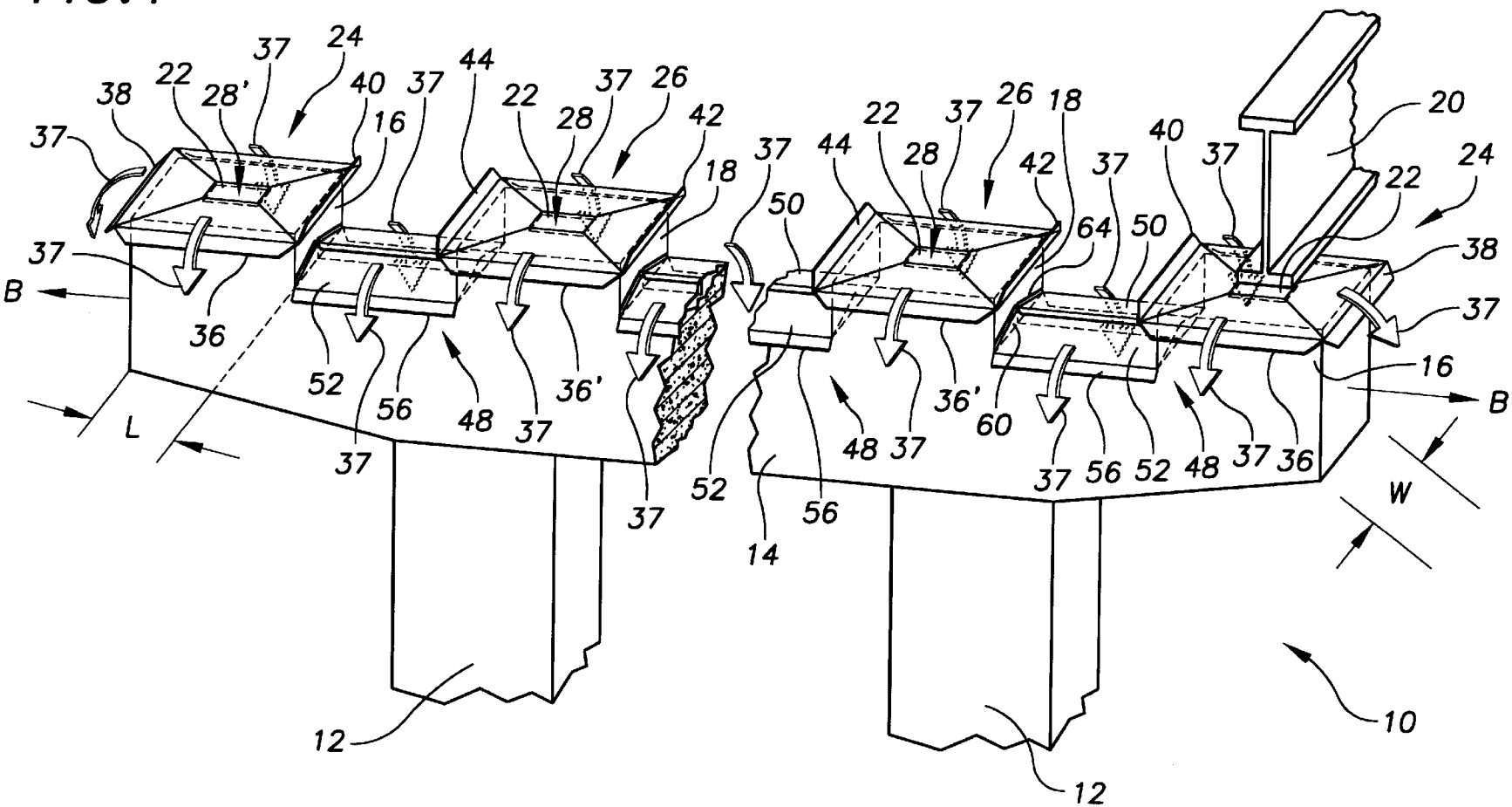
FIG. 1 is a perspective view of the present invention in use on a conventional, bridge support structure.

Referring now to the drawings wherein like reference numerals refer to like parts throughout, there is seen in FIG.

1 a concrete bridge support structure, denoted generally by reference numeral 10. Bridge support 10 consists of a pair of columns 12 on which a beam 14 is supported. Beam 14 includes outer pillars 16 and middle pillars 18 on each one of which an I-beam 20 (one shown) is mounted. Each pillar 16, 18 includes a square, metal plate 22 bolted thereto and to which the I-beams 20 are welded, thereby providing a secure connection between the I-beams 20 and pillars 16, 18. The I-beams 20 provide the surfaces on -which the bridge's road surface (not shown) is ultimately constructed.

Figure 5:
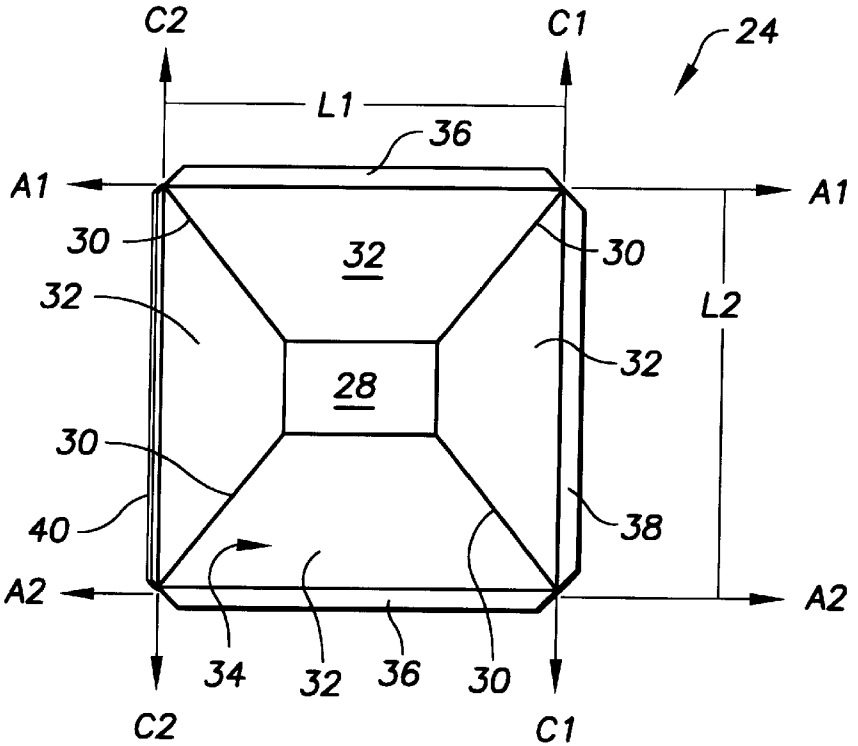
FIG. 5 is a top plan view of an outer pillar, cover plate.
Figure 4:
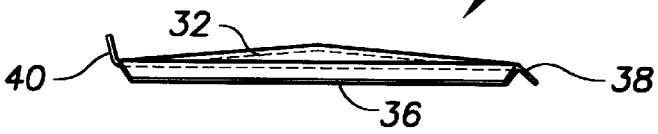
FIG. 4 is a front elevational view of an outer pillar, cover plate.
Figure 3:
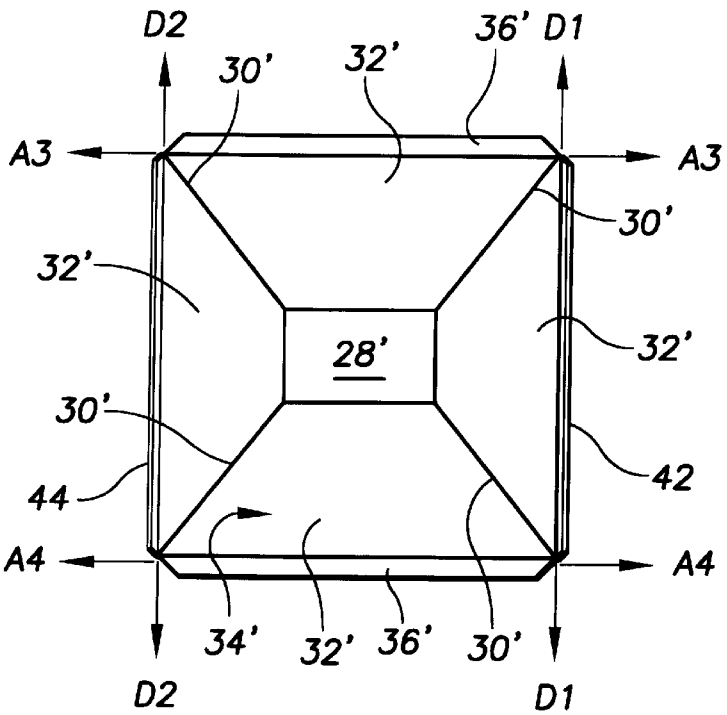
FIG. 3 is a top plan view of a middle pillar, cover plate.
Figure 2:
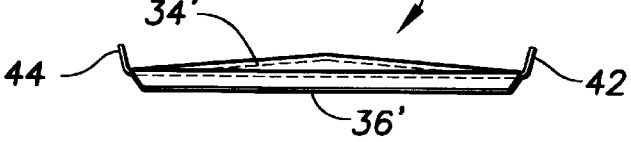
FIG. 2 is a front elevational view of a middle pillar, cover plate.

Mounted to the top surfaces of each pillar 16, 18 is an essentially square cover plate, denoted generally by reference numeral 24 (see FIGS. 4–5), 26 (see FIGS. 2–3), respectively. Each edge of cover plates 24, 26 is of a length L1 or L2 both of which are longer than the width w or lenght l of beams 14 and pillars 16, 18, thereby providing for a predetermined overhang (about 6 inches has been found to be sufficient). And each cover plate 24, 26 includes an essentially rectangular opening 28, 28', respectively, formed concentrically therethrough and through which weld plates 22 protrude and to which plates 24, 26 are welded), as well as having their bottom surfaces diagonally scored along lines 30, 30', thereby dividing each plate 24, 26 into essentially, four identical sections 32, 32', respectively. Each section 32, 32' is bent downwardly about score lines 30, 30' to ensure that each section (as perceived from the upper surfaces 34, 34' of plates 24, 26, respectively), slopes downwardly from openings 28, 28' towards the edges to which they are contiguous. A further similarity between plates 24, 26 is found with the opposing edges 36, 36', respectively, that overhang the ground and are bent about their respective axes A1—A1, A2—A2, A3—A3, and A4—A4 at an oblique, downward angle. Axes A—A extend parallel to the longitudinal axis B—B of beam 14. By edges 36, 36' being bent downwardly at an oblique angle, they serve as a flashing for pillars 16, 18, preventing water running off plates 24, 26 from sticking to the plates' bottom surfaces and causing water to drip away from beam 14 and pillars 16, 18, as indicated by arrows 37 which illustrate the direction of the flowing water.

Among the differences between plates 24, 26 are the edges which extend perpendicular to edges 36, 36'. Plate 24 is positioned in covering relation to the top of an outer pillar 16. Therefore, one edge 38 overhangs the ground while the opposite edge 40 overhangs beam 14. In order to effectively prevent water from contacting beam 14, edge 38 is bent at an oblique, downward angle about longitudinal axis C1—C1, essentially identical to the angle at which edges 36 extend. Thus, edge 38 acts as a flashing to cause water to drip directly downwardly from its terminus. Edge 40, however, is bent at an oblique, upward angle about an axis C2—C2, thereby forming a gutter to effectively channel water running down the section 32 that is contiguous to edge 40 towards edges 36 and away from beam 14. Thus, edges 36, 38 and 40 effectively prevent any water from ever coming into contact with pillars 16 or the portions of beam 14 in their vicinity, as indicated by arrows 37.

Plate 26 is positioned in covering relation to the top of a middle pillar 18. Therefore, in order to prevent water from sliding off of plate 26 and onto beam 14, both edges 42, 44 are bent at an oblique, upward angle about longitudinal axis D1—D1, D2—D2, respectively, in the same way that edge 40 was bent about axis C2—C2. Axes D1—D1 and D2—D2 extend perpendicularly to axes A3—A3 and A4—A4, and, consequently, edges 42, 44 extend perpendicularly to edges 36'. The upward bend of edges 42, 44 effectively form a gutter for the water running off of those sections 32' contiguous therewith, thereby channeling the water towards edges 36' and away from pillars 18 and the portions of beam 14 in the proximity thereof, as indicated by arrows 37.

Figure 6:
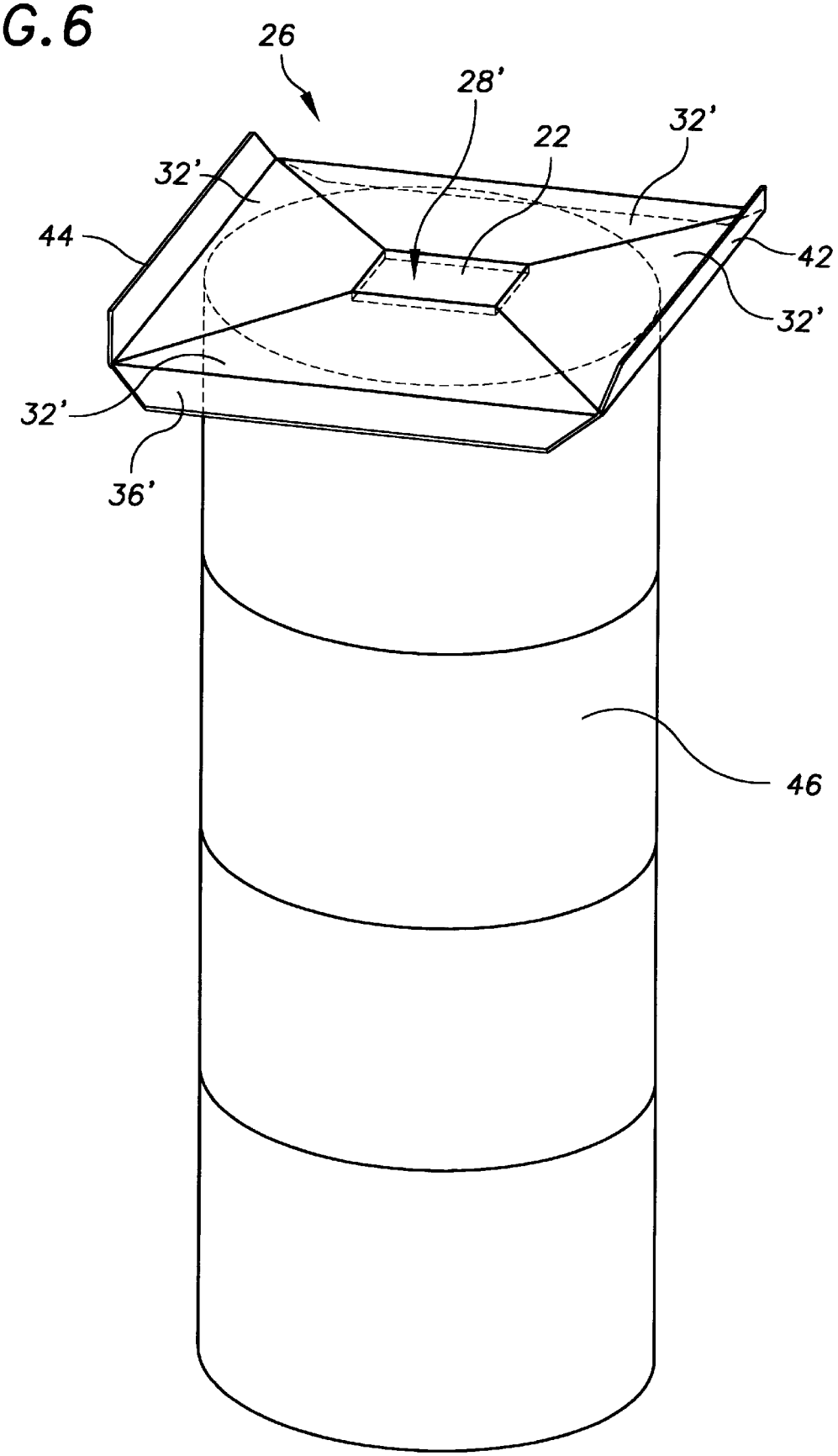
FIG. 6 is a perspective view of a sole bridge pillar having a cover plate attached to the top thereof.

With reference to FIG. 6, in some bridge constructions a support pillar 46 may be separated from any support beams. In order to protect any such pillars 46, the plate 26 previously described may be placed in complete covering relation over the pillar's top. Such an arrangement will prevent water, snow, salt or ice from contacting at least the top portion of pillar 46.

To protect the portions of beam 14 which span each section in between consecutively spaced pillars 16, 18, a recti-linear plate 48 is positioned in complete covering and fixedly secured (with any conventional fastener) relation to the entire span of each beam section. Plate 48 is of a width L3 that is wider than the width w of beam 14. Accordingly, any runoff from plates 24, 26 or any rain, snow, ice or salt that falls in between plates 24, 26 will be prevented from reaching beam 14 by cover plates 48.

Figure 8:
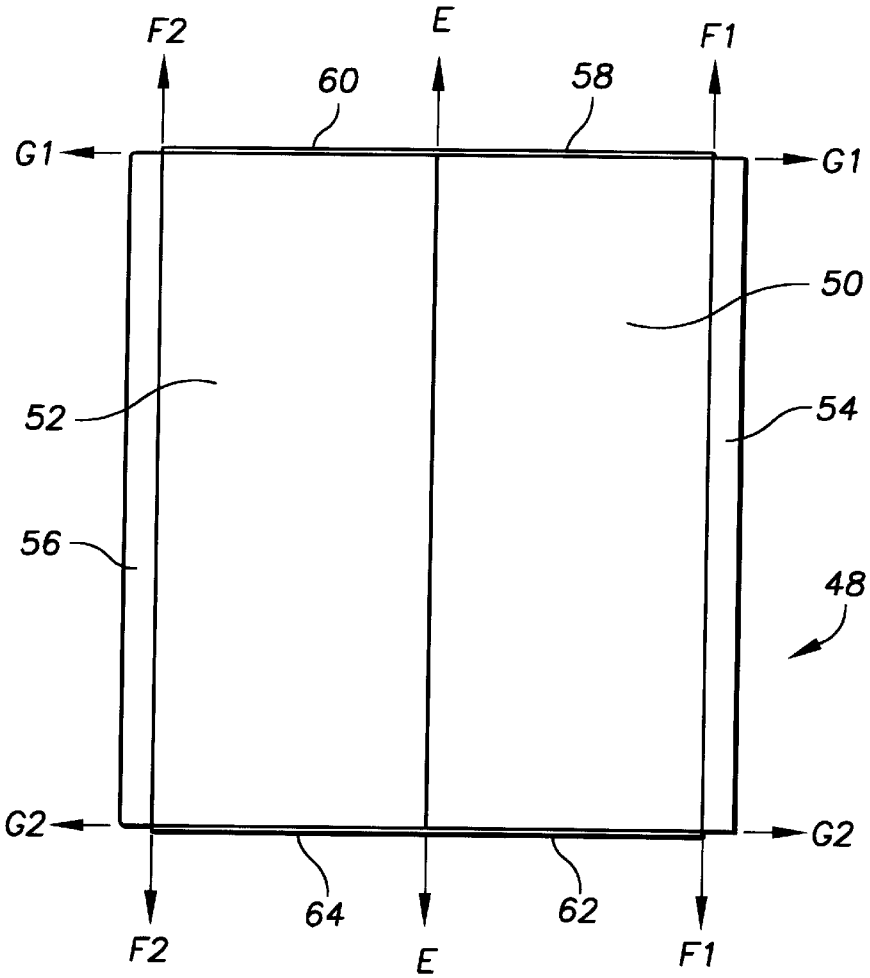
FIG. 8 is a top plan view of a beam cover plate.
Figure 7:
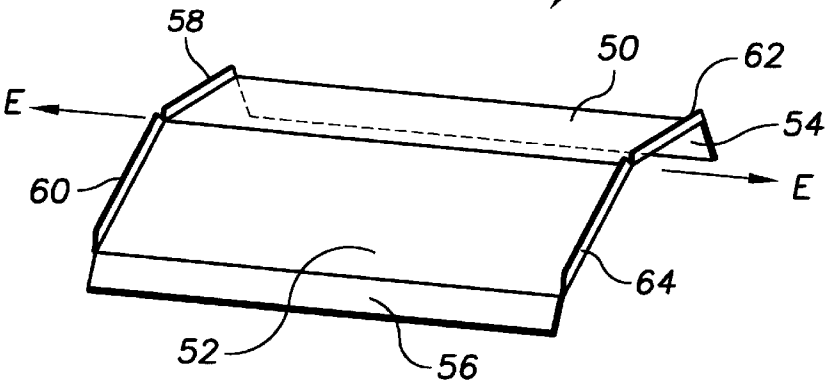
FIG. 7 is a perspective view of a beam cover plate.
Figure 9:
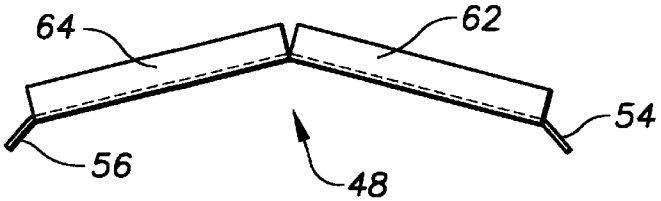
FIG. 9 is a side elevational view of a beam cover plate.

Cover plate 48 is bent downwardly about its central, longitudinal axis E—E, thereby forming two, downwardly sloping, planar surfaces 50, 52. The elongated edges 54, 56 of surfaces 50, 52, respectively, are each further bent downwardly about respective axes F1—F1, F2—F2, thereby forming a flashing from which any rain water running off of surfaces 50, 52 may drip. To prevent any water, snow, ice or salt from forming beneath cover plate 48 and to prevent anything from contacting pillars 16, 18, to which cover plate 48 abuts, the side edges 58, 60 and 62, 64 of surfaces 50, 56, respectively, are bent upwardly about their respective axes G1—G1 G1 and G2—G2 (see FIG. 8). Axes G1—G1 and G2—G2 extend perpendicular to axes F1—F1 and F2—F2. The upward bend of edges 58, 60, 62 and 64 creates a gutter along the plate's edges which abut pillars 16, 18, and in combination with the downwardly sloping surfaces 50, 52 and overhanging width L3 effectively channel rain water and other substances off of plate 48 and away from beam 14.

Figure 12:
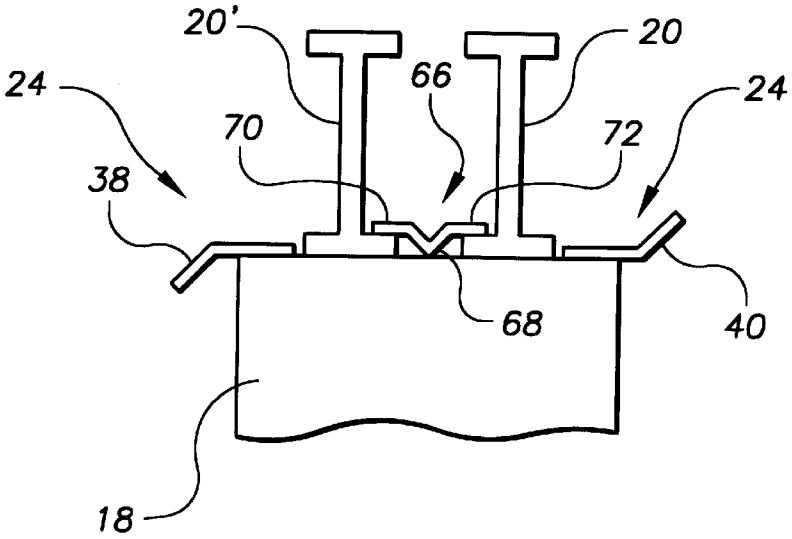
FIG. 12 is a front elevational view of a bridge pillar having two I-beams mounted thereon and an I-beam gutter extending between the I-beams.
Figure 10:
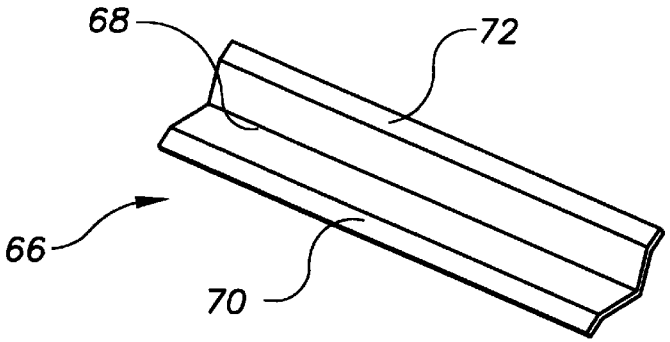
FIG. 10 is a perspective view of an I-beam gutter.
Figure 11:
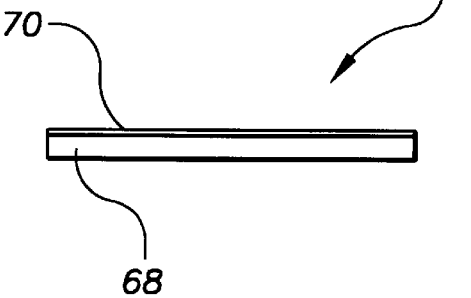
FIG. 11 is a side elevational view of an I-beam gutter.

Referring now to FIGS. 10–12 there is seen the bridge pillar 18 described earlier having a pair of I-beams 20, 20', as opposed to a single I-beam 20, fixedly mounted to weldplates affixed to the pillar's top surface. I-beams 20, 20' extend in spaced, parallel relation to one another, and such an arrangement is a common form of construction. A pair of the square cover plates 24 (or 26) may be used on such an arrangement to protect the outer portion of pillar 18.

In addition to cover plate 24, an I-beam gutter, denoted generally by reference numeral 66, is positioned between, and extends along the entire length of I-beams 20, 20'. I-beam gutter 66 includes a V-shaped channel 68 having essentially planar flanges 70, 72 extending perpendicularly outwardly from its terminal ends. Flanges 70, 72 are welded (preferably) to the upwardly facing surfaces of the lower end of each I-beam 20, 20', respectively, thereby providing a secure connection between the I-beams and gutter 66, with V-shaped channel 68 extending in between I-beams 20, 20'.

The system of cover plates 24, 26 and 48 results in a complete covering of the top surfaces of a bridge's major support structures. This covering will prevent or greatly diminish the rate at which erosion degrades the supports, and consequently, reduces the frequency at which a bridge must be maintained and repaired.

What is claimed is:

1. In a system for providing coverage and protection from water to bridge support structures consisting of a plurality of laterally spaced apart pillars interconnected by spans of beam, each of said pillars and spans having first and second pairs of edges extending in spaced, parallel relation to one another, respectively, and a respective predetermined width and length, said pillars and spans of beam having a common longitudinal axis, said pillars further having a weld plate securely affixed to the top surface thereof, and said systems comprising:

a) a first plate having a substantially planer major surface, and being positioned in covering relation to each of said plurality of pillars, and having:

i) a predetermined periphery extending in overhanging relation to said first and second pairs of edges of said pillars;

ii) first means for channeling said water away from said pillars, including those portions of said first plate's predetermined periphery overhanging said first paid of edges of said pillar extending at an oblique, downward angle with respect to said first plate's major surface, and those portions of said predetermined periphery overhanging said second pair of edges of said pillar extending at either of an oblique, downward angle and an oblique, upward angle with respect to said first plate's major surface.

b) a second plate having at least one substantially planer major surface, and being positioned in covering relation to each of said spans of beam, and having:

i) a predetermined periphery extending in overhanging relation to said first pair of edges of said span of beam; and ii) second means for channeling said water a from said span of beam, including those portions of said second plate's predetermined periphery overhanging said first pair of edges of said span of beams extending at an oblique, downward angle with respect to said second plate's major surface, and the remaining portions of said second plate's predetermined periphery being positioned in covering upturned relation to said second pair of edges of said span of beam.

2. The system of claim 1, wherein said first plate's predetermined periphery is rectangularly shaped, thereby consisting of four elongated, terminal edges each being disposed at about 90 degree angles with respect to the adjacent terminal edges.

3. The system of claim 2, wherein said first water channeling means includes each of said four elongated, terminal edges being bent at a downwardly oblique angle about respective, longitudinal axes, thereby forming a flashing along each of said terminal edges.

4. The system of claim 3, wherein each of said first plates includes first and second diagonal score lines formed thereon, thereby dividing each of said first plates into four equal sections which terminate along four respective edges.

5. The system of claim 4, wherein said first water channeling means further includes each of said four equal sections sloping downwardly from said central opening towards said respective edges.

6. The system of claim 2, wherein said first water channeling means includes two of said first plate's four elongated edges being positioned opposite one another being bent at a downward oblique angle about respective, longitudinal axes, thereby forming a flashing along each of those two edges, and the other two of said four elongated edges being bent at an upward, oblique angle about respective longitudinal axes, thereby forming a gutter along each of those two edges.

7. The system of claim 2, wherein said first water channeling means includes three of said four elongated edges being bent at a downward, oblique angle about respective longitudinal axes, thereby forming a flashing along each of those three edges, and the other one of said four elongated edges being bent at an upward, oblique angle about a respective longitudinal axis, thereby forming a gutter along that edge.

8. The system of claim 1, wherein said alter second plates four predetermined periphery is rectangularly shaped, thereby consisting of four elongated, terminal edges each being disposed at about 90 degree angles with respect to the adjacent terminal edges.

9. The system of claim 8, wherein said second water channeling means includes two of said four elongated edges which extend in parallel relation to one another are bent at an upward oblique angle about respective longitudinal axes, thereby forming gutters along each of those two edges each of said two edges being positioned in abutting relation to a respective one of said pillars.

10. The system of claim 9, wherein said second water channeling means further includes said second plate having a central, longitudinal axis about which said second plate is bent at a downward, oblique angle, thereby dividing said second plate into two equal sections that slope downwardly from said central, longitudinal axis towards two of said four elongated edges.

11. In a system for providing coverage and protection from water to bridge support structures consisting of a plurality of laterally spaced apart pillars interconnected by spans of beam, each of said pillars and spans having first and second, pairs of edges extending in spaced, parallel relation to one another, respectively, and a respective predetermined width and length, each of said pillars further having first and second weld plates affixed to the top surface thereof, said first and second weld plates having first and second I-beams welded thereto, respectively, said first and second I-beam extending in spaced parallel relation to one another, said system comprising:

a) a first plate positioned in partially covering relation to each of said plurality of pillars and having:

i) a predetermined periphery extending in overhanging relation to said first pair of edges of said pillars; and ii) first means for channeling said water away from said pillars.

b) a second plate positioned in covering relation to each of said spans of beam, and having:

i) a predetermined periphery extending in overhanging relation to said second pair of edges of said span of beam; and ii) second means for channeling water away from said spans of beam; and c) a third plate attached to each of said first and second I-beam, and extending in between and in parallel relation thereto and including first and second flanges fixedly attached to said first and second I-beams, respectively, and a V-shaped gutter integrally extending downwardly from said first and second flanges.

12. The system of claim 11, wherein said second plate's predetermined periphery is rectangularly shaped, thereby consisting of four elongated, terminal edges each being disposed at about 90 degree angles with respect to the adjacent terminal edges.

13. The system of claim 12, wherein said second water channeling means includes two of said four elongated edges which extend in parallel relation to one another are bent at an upward oblique angle about respective longitudinal axes, thereby forming gutters along each of those two edges each of said two edges being positioned in abutting relation to a respective one of said pillars.

14. The system of claim 13, wherein said second water channeling means further includes the other two of said four elongated, terminal edges being bent at a downward, oblique angle about respective longitudinal axes, thereby forming a flashing along each of those two edges, and each of those said edges being positioned in overhanging relation to said spans of beam.

15. The system of claim 14, wherein said second water channeling means further includes said second plate having a central, longitudinal axis about which said second plate is bent at a downward, oblique angle, thereby dividing said second plate into two equal sections that slope downwardly from said central, longitudinal axis towards two of said four elongated edges.

* * * * *

UNITED STATES PATENT AND TRADEMARK OFFICE

CERTIFICATE OF CORRECTION

PATENT NO. : 5,920,937

DATED : July 13, 1999

INVENTOR(S) : Tracy

It is certified that error appears in the above-indentified patent and that said Letters Patent is hereby corrected as shown below:

Claim 1, line 38, after water please delete "a" and insert --away--
Claim 8, line 1, after said please delete "alter"
line 1, please delete "plates" and insert --plate's--
line 2, please delete "four"

Signed and Sealed this
First Day of February, 2000

*Attest:*

*Attesting Officer*

Q. TODD DICKINSON

*Acting Commissioner of Patents and Trademarks*